US008551211B2

(12) United States Patent
Oilmann et al.

(10) Patent No.: US 8,551,211 B2
(45) Date of Patent: Oct. 8, 2013

(54) NANOWIRE PREPARATION METHODS, COMPOSITIONS, AND ARTICLES

(75) Inventors: Richard R. Oilmann, Woodbury, MN (US); William D. Ramsden, Afton, MN (US); Doreen C. Lynch, Afton, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 13/347,986

(22) Filed: Jan. 11, 2012

(65) Prior Publication Data

US 2012/0207644 A1 Aug. 16, 2012

Related U.S. Application Data

(60) Provisional application No. 61/442,874, filed on Feb. 15, 2011.

(51) Int. Cl.

| | |
|---|---|
| ***C22C 5/06*** | (2006.01) |
| ***B82Y 40/00*** | (2011.01) |
| ***B22F 9/18*** | (2006.01) |

(52) U.S. Cl.
USPC ..... 75/371; 75/741

(58) Field of Classification Search
USPC ..... 420/501
See application file for complete search history.

(56) References Cited

U.S. PATENT DOCUMENTS

2010/0242679 A1* 9/2010 Yu et al. ..... 75/345
2010/0269635 A1* 10/2010 Vanheusden et al. ..... 75/370

OTHER PUBLICATIONS

Tang et al., Syntheses of silver nanowires in liquid phase, Nanowire Science and Technology, Feb. 2010, p. 25-42.*
Huang et al. Continuous-flow biosynthesis of silver nanoparticles by lixivium of sundried *Cinnamomum camphora* leaf in tubular microreactor, Ind. Eng. Chem. Res. 2008, vol. 47, p. 6081-6090.*
Johann Boleininger, et al., "Microfluidic continuous flow synthesis of rod-shaped gold and silver nanocrystals," Phys. Chem. Chem. Phys., 2006, 8, pp. 3824-3827, XP-002535011.
Suhanya Duraiswamy, et al., "Droplet—Based Microfluidic Synthesis of Anisotropic Metal Nanocrystals," Small Journal, 2009, 5, No. 24, pp. 2828-2834, XP-55026129.
International Search Report completed May 3, 2012 for International Application No. PCT/US2012/021028, 3 pages.

* cited by examiner

*Primary Examiner* — Roy King
*Assistant Examiner* — Xiaowei Su
(74) *Attorney, Agent, or Firm* — Reed L. Christiansen

(57) ABSTRACT

Methods of producing metal nanowires employing tubular continuous-flow reactors and their products are described and claimed. Such methods can provide superior nanowire uniformity without agglomeration. Such nanowires are useful for electronic applications.

9 Claims, 7 Drawing Sheets

NANOWIRE PREPARATION METHODS, COMPOSITIONS, AND ARTICLES

CROSS REFERENCE TO RELATED APPLICATIONS

This application claims the benefit of U.S. Provisional Application No. 61/442,874, filed Feb. 15, 2011, entitled NANOWIRE PREPARATION METHODS, COMPOSITIONS, AND ARTICLES, which is hereby incorporated by reference in its entirety.

SUMMARY

At least a first embodiment provides methods comprising feeding at least one first composition comprising at least one first reducible metal ion to the contents of at least one continuous-flow reactor comprising at least one tubular reactor; reducing the at least one reducible metal ion to at least one metal nanowire; and withdrawing at least one second composition comprising the at least one metal nanowire from the contents of the at least one continuous-flow reactor. In at least some embodiments, at least some of the withdrawing of the at least one second composition occurs before at least some of the feeding of the at least one first composition, or it occurs simultaneously with at least some of the feeding of the at least one first composition, or both. In some cases, the contents of the tubular reactor are not mixed with a rotating agitator. The at least one continuous-flow reactor may optionally consist essentially of the at least one tubular reactor.

In at least some embodiments, the at least one first composition further comprises at least one polyol and at least one of a protecting agent, a polar polymer, or a polar copolymer. In some cases, all of the components to be fed to the at least one continuous reactor may, for example, be combined to form a single feed composition.

In some cases, the at least one first reducible metal ion may comprise at least one coinage metal ion, at least one ion from IUPAC Group 11, or at least one ion of silver. In at least some embodiments, the reduction may be performed in the presence of at least one second ion or atom comprising at least one ion or atom from IUPAC Group 8, at least one ion or atom from IUPAC Group 14, at least one iron ion or atom, or at least one tin ion or atom. In some cases, the reduction may be performed in the presence of a halide ion, such as, for example, a bromide ion, a chloride ion, or an iodide ion, or the reduction may, in some cases, be performed in the presence of a chloride ion.

At least some embodiments provide the metal nanowires produced according to such methods. The metal nanowires produced according to such methods may, for example, comprise a length of at least about 10 μm, or from about 10 μm to about 50 μm, or of approximately 20 μm.

At least some other embodiments provide one or more articles comprising at least one such nanowire. Such articles may, for example, comprise electronic devices, transparent conductive films, and the like.

At least a second embodiment provides methods comprising providing at least one first composition comprising at least one first reducible metal ion, and reducing the at least one first reducible metal ion to at least one first metal in the presence of at least one first protecting agent and at least one first solvent, where the reduction is performed in at least one first continuous-flow reactor comprising at least one tubular reactor. In at least some embodiments, the at least one first reducible metal ion comprises at least one coinage metal ion, or at least one ion from IUPAC Group 11, or at least one ion of silver. In some cases, the at least one first compound comprises silver nitrate. In at least some embodiments, the reduction may be carried out in the presence of at least one element from IUPAC Group 8, such as, for example, iron or an ion of iron, or in the presence of at least one element from IUPAC Group 14, such as, for example, tin or an ion of tin, or in the presence of at least one metal salt, such as, for example, at least one metal chloride. In at least some embodiments, the at least one first protecting agent comprises at least one of one or more surfactants, one or more acids, or one or more polar solvents, or it may, for example, comprise polyvinylpyrrolidinone. In at least some cases, the at least one first solvent comprises at least one polyol, such as, for example, one or more of ethylene glycol, propylene glycol, glycerol, one or more sugars, or one or more carbohydrates. In at least some embodiments, the composition has a ratio of the total moles of the at least one second metal or metal ion to the moles of the at least one first reducible metal ion from about 0.0001 to about 0.1. The reduction may be carried out at one or more temperatures, such as, for example, from about 80° C. to about 190° C. In at least some embodiments, the second composition comprises at least one coinage metal or coinage metal ion, or at least one element from IUPAC Group 11, such as, for example, silver or an ion of silver.

At least some embodiments provide such methods, where the reduction is carried out in the presence of at least one second composition comprising seed particles. The at least one second composition may comprise at least one coinage metal or coinage metal ion, or at least one element from IUPAC Group 11, such as, for example, silver or an ion of silver. In at least some embodiments, the seed particles are formed by a method comprising providing at least one third metal ion and contacting the at least one third metal ion with at least one second protecting agent and at least one second solvent. Such a method may, for example, be carried out in at least one second continuous-flow reactor, which may, for example, comprise at least one tubular reactor.

Other embodiments provide the first metal product formed by any of these methods. Such a product may, for example, comprise one or more of nanowires, nanocubes, nanorods, nanopyramids, or nanotubes. Such nanowires may have an average diameter of about 30 to about 150 nm, or from about 30 to about 110 nm, or from about 80 to about 100 nm. Some embodiments provide one or more articles comprising at least one such nanowire. Such articles may, for example, comprise electronic devices, transparent conductive films, and the like.

These embodiments and other variations and modifications may be better understood from the brief description of figures, figures, description, exemplary embodiments, examples, and claims that follow.

DESCRIPTION

All publications, patents, and patent documents referred to in this document are incorporated by reference herein in their entirety, as though individually incorporated by reference.

U.S. Provisional Application No. 61/442,874, filed Feb. 15, 2011, entitled NANOWIRE PREPARATION METHODS, COMPOSITIONS, AND ARTICLES, is hereby incorporated by reference in its entirety.

Introduction

Silver nanowires (AgNW) are a unique and useful wire-like form of the metal in which the two short dimensions (the thickness dimensions) are less than 300 nm, while the third dimension (the length dimension) is greater than 1 micron, preferably greater than 10 microns, and the aspect ratio (ratio of the length dimension to the larger of the two thickness dimensions) is greater than five. They are being examined as conductors in electronic devices or as elements in optical devices, among other possible uses.

A number of procedures have been presented for the preparation of AgNW. See, for example, Y. Xia, et al. (*Angew. Chem. Int. Ed.* 2009, 48, 60), which is hereby incorporated by reference in its entirety. These include the "polyol" process, in which a silver salt is heated in a polyol (typically ethylene glycol (EG)) in the presence of polyvinylpyrrolidone (PVP), yielding a suspension of AgNW in EG, from which the wires can be isolated and/or purified as desired.

Y. Sun, B. Mayers, T. Herricks, and Y. Xia (*Nano Letters,* 2003, 3(7), 955-960), hereby incorporated by reference in its entirety, propose that AgNW are the result of the growth of multiply-twinned particles (MTP) of silver metal. P.-Y. Silvert et al. (*J. Mater. Chem.,* 1996, 6(4), 573-577 and *J. Mater. Chem.,* 1997, 7, 293-299, both of which are hereby incorporated by reference in their entirety) describe the formation of colloidal silver dispersions in EG in the presence of PVP. Chen et al. (*Nanotechnology,* 2006, 17, 466-74), hereby incorporated by reference in its entirety, describe effects of changing seed concentrations on morphology.

US patent publication 2010/0242679 and Japanese patent publication 2010-255037 describe AgNW synthesis using continuous-flow stirred tank reactors.

Applicants have discovered that continuous-flow tubular reactors may be used to produce high aspect ratio AgNW with narrow nanowire length distributions. Such tubular reactors can enable precise control of temperature and reaction time without use of excessive agitation, thereby improving product uniformity.

Figure 1:
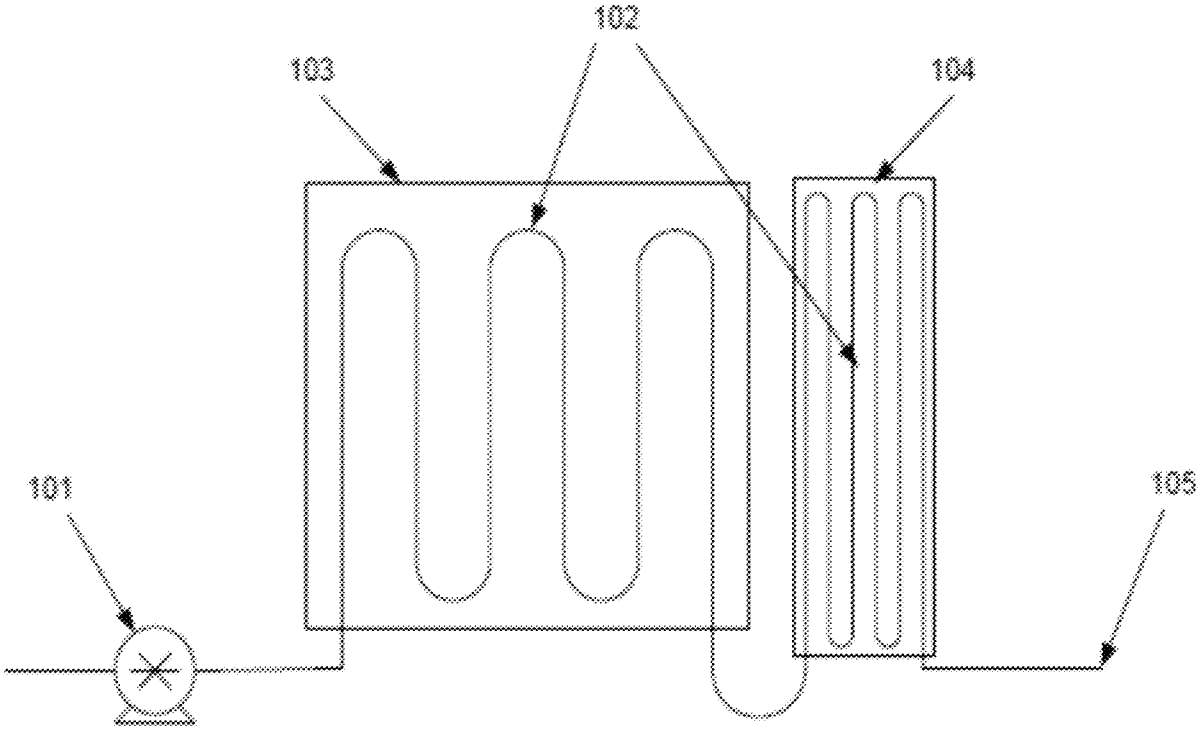
FIG. 1 shows an embodiment of a reaction system with a continuous-flow tubular reactor.

FIG. 1 shows an embodiment of a reaction system with a continuous-flow tubular reactor. A feed pump [101] supplies raw materials, catalysts, and solvents to the continuous-flow tubular reactor [102], a portion of which is contained in a thermostatted oven [103]. The downstream portion of the tubular reactor is immersed in a quench bath [104], with the product exiting the outlet of the reactor [105].

Figure 2:
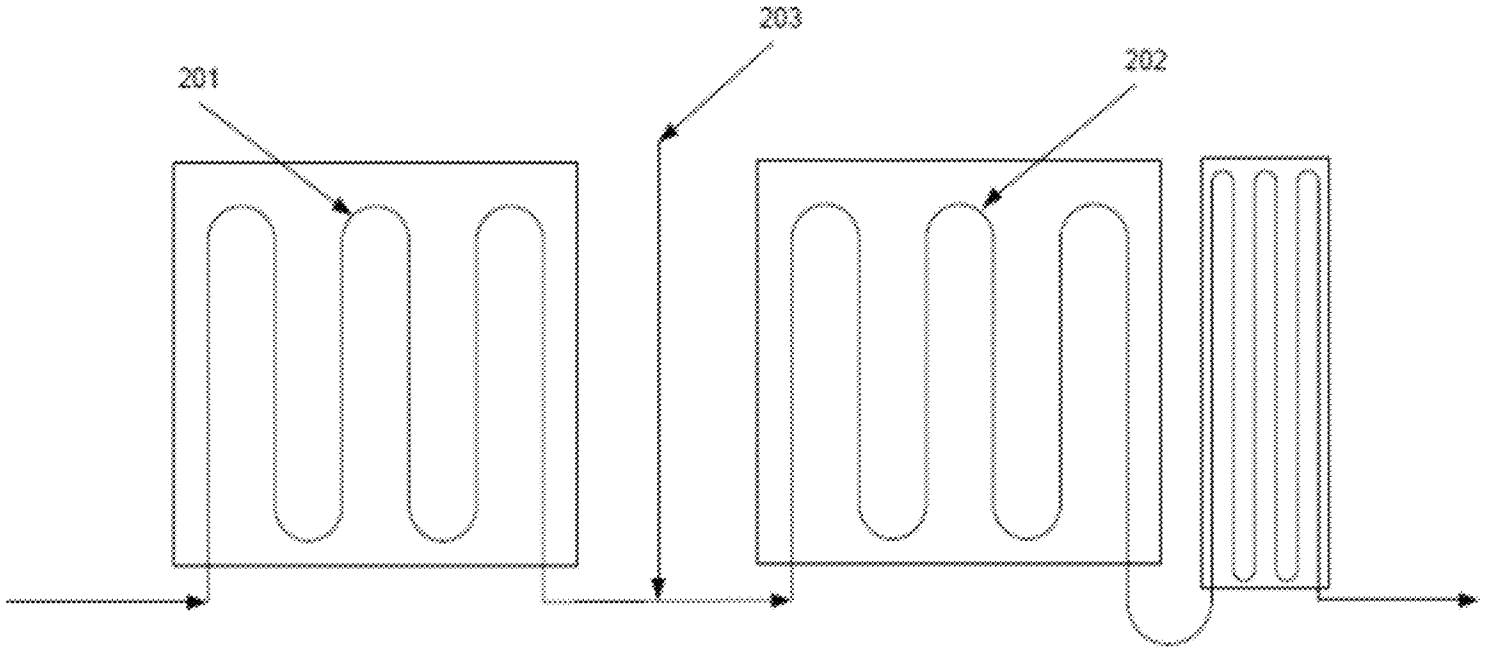
FIG. 2 shows an embodiment of a reaction system with two continuous-flow tubular reactor stages and an inter-stage feed point.

FIG. 2 shows an embodiment of a reaction system with two continuous-flow tubular reactor stages and an inter-stage feed point, where the feed pumps have been omitted from the figure for clarity. The first tubular reactor stage [201] may, for example, be used to prepare a seed dispersion, which is fed to the second reactor stage [202]. The other raw materials, catalysts, and solvents may also be supplied to the second reactor stage at the inter-stage feed point [203].

Reducible Metal Ions and Metal Products

Some embodiments provide methods comprising reducing at least one reducible metal ion to at least one metal nanowire. A reducible metal ion is a cation that is capable of being reduced to a metal under some set of reaction conditions. In such methods, the at least one first reducible metal ion may, for example, comprise at least one coinage metal ion. A coinage metal ion is an ion of one of the coinage metals, which include copper, silver, and gold. Or such a reducible metal ion may, for example, comprise at least one ion of an IUPAC Group 11 element. An exemplary reducible metal ion is a silver cation. Such reducible metal ions may, in some cases, be provided as salts. For example, silver cations might, for example, be provided as silver nitrate.

Preparation Methods

A common method of preparing nanostructures, such as, for example, nanowires, is the "polyol" process. Such a process is described in, for example, *Angew. Chem. Int. Ed.* 2009, 48, 60, Y. Xia, Y. Xiong, B. Lim, S. E. Skrabalak, which is hereby incorporated by reference in its entirety. Such processes typically reduce a metal cation, such as, for example, a silver cation, to the desired metal nanostructure product, such as, for example, a silver nanowire. Such a reduction may be carried out in a reaction mixture that may, for example, comprise one or more polyols, such as, for example, ethylene glycol (EG), propylene glycol, butanediol, glycerol, sugars, carbohydrates, and the like; one or more protecting agents, such as, for example, polyvinylpyrrolidinone (also known as polyvinylpyrrolidone or PVP), other polar polymers or copolymers, surfactants, acids, and the like; and one or more metal ions. These and other components may be used in such reaction mixtures, as is known in the art. The reduction may, for example, be carried out at one or more temperatures from about 80° C. to about 190° C.

Metals, Metals Ions, Halides, and Metal Halides

In some embodiments, the reduction may be carried out in the presence of one or more metals or metal ions (different from the at least one reducible metal ion), or in the presence of one or more halide ions, or both. The metal ions used to catalyze wire formation are generally primarily reported to be provided as a metal halide salt, usually as a metal chloride, for example, $FeCl_2$ or $CuCl_2$. See, for example, J. Jiu, K. Murai, D. Kim, K. Kim, K. Suganuma, *Mat. Chem. & Phys.,* 2009, 114, 333, which refers to NaCl, $CoCl_2$, $CuCl_2$, $NiCl_2$ and $ZnCl_2$; Japanese patent application publication JP2009155674, which describes $SnCl_4$; S. Nandikonda, "Microwave Assisted Synthesis of Silver Nanorods," M. S. Thesis, Auburn University, Aug. 9, 2010, which refers to NaCl, KCl, $MgCl_2$, $CaCl_2$, $MnCl_2$, $CuCl_2$, and $FeCl_3$; S. Nandikonda and E. W. Davis, "Effects of Salt Selection on the Rapid Synthesis of Silver Nanowires," Abstract INOR-299, 240th ACS National Meeting, Boston, Mass., Aug. 22-27, 2010, which discloses NaCl, KCl, $MgCl_2$, $CaCl_2$, $MnCl_2$, $CuCl_2$, $FeCl_3$, $Na_2S$, and NaI; Chinese patent application publication CN101934377, which discloses $Mn^{2+}$; Y. C. Lu, K. S. Chou, *Nanotech.,* 2010, 21, 215707, which discloses $Pd^{2+}$; and Chinese patent application publication CN102029400, which discloses NaCl, $MnCl_2$, and $Na_2S$. Use of KBr has been disclosed in, for example, D. Chen et al., *J. Mater. Sci.: Mater. Electron.,* 2011, 22(1), 6-13; L. Hu et al., *ACS Nano,* 2010, 4(5), 2955-2963; and C. Chen et al, *Nanotechnology,* 2006, 17, 3933. Use of NaBr has been disclosed in, for example, L. Zhou et al., *Appl. Phys. Letters,* 2009, 94, 153102. Japanese patent application publication 2009-155674 discloses use of $SnCl_4$. U.S. patent application publication 2010/0148132 discloses use of NaCl, KCl, $CaCl_2$, $MgCl_2$, and $ZnCl_2$. U.S. patent application publications 2008/0210052 and 2011/0048170 disclose use of quaternary ammonium chlorides. See also Z. C. Li et al., *Micro & Nano Letters,* 2011, 6(2), 90-93; and B. J. Wiley et al., *Langmuir,* 2005, 21, 8077. These and other compounds will be understood by those skilled in the art.

Continuous-Flow Reactors and Tubular Reactors

In at least some embodiments, at least one metal ion is reduced to at least one metal in a continuous-flow reactor. In such a continuous-flow reactor, at least one feed composition or compositions ("feed") comprising the at least one metal ion is supplied to the reactor and at least one product composition or compositions ("product") comprising the at least one metal is withdrawn from the reactor. The feed may, for example, by supplied at a fixed flow rate, at a time varying flow rate, intermittently, and so on. The product may, for example, be withdrawn at a fixed flow rate, at a time varying flow rate, intermittently, and so on.

In such a continuous-flow reactor, at least some of the feed is supplied to the reactor after at least some of the product is withdrawn from the reactor. This may be contrasted with a batch reactor, where substantially all of the feed compositions comprising the at least one metal ion are supplied to the reactor prior to or at the start of the reduction, and where substantially all of the product compositions are withdrawn after the feed compositions are fed. And it may be contrasted with a semi-batch reactor, where some of the feed compositions are supplied prior to or at the start of the reduction and some of the feed compositions are supplied thereafter, and where substantially all of the product compositions are withdrawn after the feed compositions are fed.

The temperature of the contents of a continuous-flow reactor may be uniform or may vary according to location or time. The pressure of the contents of a continuous-flow reactor may be uniform or may vary according to location or time. The number of phases present in the continuous-flow reactor may be uniform or may vary according to location or time.

In at least some embodiments, the reduction may be carried out in at least one continuous-flow reactor comprising at least one tubular reactor. In such a tubular reactor, at least one feed composition or compositions ("feed") comprising the at least one metal ion is supplied to one or more inlets to the reactor and at least one product composition or compositions ("product") comprising the at least one metal is withdrawn from one or more outlets of the reactor. The feed may, for example, by supplied at a fixed flow rate, at a time varying flow rate, intermittently, and so on. The product may, for example, be withdrawn at a fixed flow rate, at a time varying flow rate, intermittently, and so on.

Such a tubular reactor may be contrasted with a stirred reactor, which comprises one or more rotating agitators to mix the reactor's contents. A tubular reactor will have at least one path between at least one inlet and at least one outlet that does not contact such a rotating agitator. In some cases, all paths between inlets and outlets of the reactor will not contact such a rotating agitator.

In at least some embodiments, such a tubular reactor may optionally comprise one or more static mixing elements between at least some of its inlets and outlets. Such static mixing elements may, in some cases, improve product homogeneity and increase heat transfer between the reactor contents and the walls of the reactor.

In at least some embodiments, such continuous-flow reactors may be arranged as parallel or series stages of reactors. The stages may, for example, be stirred reactors, tubular reactors, or both. In such cases, feeds may be provided between at least some of the stages, or products may be withdrawn between at least some of the stages, or both. Other devices may optionally be provided between stages, such as, for example, devices for inter-stage heating or cooling of the material flowing through them.

In at least some embodiments, the feed composition comprises the at least one reducible metal ion, at least one polyol, and at least one of a protecting agent, a polar polymer, or a polar copolymer. In some cases, all of the components to be fed to the at least one continuous reactor may, for example, be combined to form a single feed mixture. Such an arrangement may, for example, provide improved product uniformity relative to that of a semi-batch reactor by reducing or eliminating variability due to changes in timing, quantities, and feed rates of the feeds to the semi-batch reactor.

In at least some embodiments, at least a portion of at least one of the product streams of a continuous-flow reactor may be provided to at least one of the inlets of the same or a different continuous-flow reactor using one or more recycle streams. Such a recycle stream may optionally comprise one or more surge tanks or compartments to help manage inventories that are not in the reactor or reactors. These and other variations will be understood by those skilled in the art.

Nanostructures, Nanostructures, and Nanowires

In some embodiments, the metal product formed by such methods is a nanostructure, such as, for example, a one-dimensional nanostructure. Nanostructures are structures having at least one "nanoscale" dimension less than 300 nm, and at least one other dimension being much larger than the nanoscale dimension, such as, for example, at least about 10 or at least about 100 or at least about 200 or at least about 1000 times larger. Examples of such nanostructures are nanorods, nanowires, nanotubes, nanopyramids, nanoprisms, nanoplates, and the like. "One-dimensional" nanostructures have one dimension that is much larger than the other two dimensions, such as, for example, at least about 10 or at least about 100 or at least about 200 or at least about 1000 times larger.

Such one-dimensional nanostructures may, in some cases, comprise nanowires. Nanowires are one-dimensional nanostructures in which the two short dimensions (the thickness dimensions) are less than 300 nm, preferably less than 100 nm, while the third dimension (the length dimension) is greater than 1 micron, preferably greater than 10 microns, and the aspect ratio (ratio of the length dimension to the larger of the two thickness dimensions) is greater than five. Nanowires are being employed as conductors in electronic devices or as elements in optical devices, among other possible uses. Silver nanowires are preferred in some such applications.

Such methods may be used to prepare nanostructures other than nanowires, such as, for example, nanocubes, nanorods, nanopyramids, nanotubes, and the like. Nanowires and other nanostructure products may be incorporated into articles, such as, for example, electronic displays, touch screens, portable telephones, cellular telephones, computer displays, laptop computers, tablet computers, point-of-purchase kiosks, music players, televisions, electronic games, electronic book readers, transparent electrodes, solar cells, light emitting diodes, other electronic devices, medical imaging devices, medical imaging media, and the like.

EXEMPLARY EMBODIMENTS

U.S. Provisional Application No. 61/442,874, filed Feb. 15, 2011, entitled NANOWIRE PREPARATION METHODS, COMPOSITIONS, AND ARTICLES, which is hereby incorporated by reference in its entirety, disclosed the following 26 non-limiting exemplary embodiments:

A. A method comprising:

providing at least one first composition comprising at least one first reducible metal ion; and reducing the at least one first reducible metal ion to at least one first metal in the presence of at least one first protecting agent and at least one first solvent, wherein the reduction is performed in at least one first continuous-flow reactor comprising at least one tubular reactor.

B. The method according to embodiment A, wherein the at least one first reducible metal ion comprises at least one coinage metal ion.

C. The method according to embodiment A, wherein the at least one first reducible metal ion comprises at least one ion from IUPAC Group 11.

D. The method according to embodiment A, wherein the at least one first reducible metal ion comprises at least one ion of silver.

E. The method according to embodiment A, wherein the at least one first compound comprises silver nitrate.

F. The method according to embodiment A, wherein the reduction is performed in the presence of at least one element from IUPAC Group 8 or IUPAC Group 14.

G. The method according to embodiment A, wherein the reduction is performed in the presence of iron or an ion of iron.

H. The method according to embodiment A, wherein the wherein the reduction is performed in the presence of tin or an ion of tin.

J. The method according to embodiment A, wherein the reduction is performed in the presence of at least one metal chloride.

K. The method according to embodiment A, wherein the at least one first protecting agent comprises at least one of: one or more surfactants, one or more acids, or one or more polar solvents.

L. The method according to embodiment A, wherein the at least one first protecting agent comprises polyvinylpyrrolidinone.

M. The method of embodiment A, wherein the at least one first solvent comprises at least one polyol.

N. The method of embodiment A, wherein the at least one first solvent comprises at least one of: ethylene glycol, propylene glycol, glycerol, one or more sugars, or one or more carbohydrates.

P. The method of embodiment A, wherein the composition has a ratio of the total moles of the at least one second metal or metal ion to the moles of the at least one first reducible metal ion from about 0.0001 to about 0.1.

Q. The method of embodiment A, wherein the reduction is carried out at one or more temperatures from about 120° C. to about 190° C.

R. The method of embodiment A, wherein the reduction is carried out in the presence of at least one second composition comprising seed particles.

S. The method of embodiment R, wherein the second composition comprises at least one coinage metal or coinage metal ion.

T. The method according to embodiment R, wherein the at least one second composition comprises at least one element from IUPAC Group 11.

U. The method according to embodiment R, wherein the at least one second composition comprises silver or an ion of silver.

V. The method according to embodiment R, wherein the seed particles are formed by a method comprising:

providing at least one third metal ion; and contacting the at least one third metal ion with at least one second protecting agent and at least one second solvent.

W. The method according to embodiment V, wherein the seed particles are formed in at least one second continuous-flow reactor.

X. The method according to embodiment W, wherein the at least one second continuous-flow reactor comprises at least one tubular reactor.

Y. At least one first metal product formed by the method of embodiment A.

Z. The product according to embodiment Y, comprising one or more of nanowires, nanocubes, nanorods, nanopyramids, or nanotubes.

AA. The product according to embodiment Y, comprising at least one nanowire.

AB. At least one article comprising at least one nanowire of embodiment AA.

EXAMPLES

Example 1

40 mL of a solution of 284.0 g polyvinylpyrrolidone (PVP, 55,000 molecular weight) in 3 L ethylene glycol (EG), 40 mL of a solution of 144.7 g $AgNO_3$ in 3 L of EG, 560 mL of EG, and 2.6 mL of a 6 mM solution of $FeCl_2$ in EG were blended and charged to an addition funnel equipped to drip into a syringe body that fed the inlet of a peristaltic pump (MASTERFLEX® 7518-10 pump head equipped with 0.188 in ID/0.375 in OD flexible tubing and driven by a 6-to-600 RPM MASTERFLEX® 7521-40 Console Drive). The outlet of the pump fed the inlet of a ca. 200 ft long run of 0.25 in OD stainless-steel tubing (0.049 in wall thickness). Approximately 95% of the tubing was located in a BLUE M® oven, with the final 5% of the tubing being immersed in an ice water bath outside of the oven. The outlet of the tubing fed a product receiver.

The oven was heated to 144.5° C., after which the pump speed control was set to deliver 11.9 mL/min and the addition funnel drip rate was adjusted to maintain a constant head upstream of the pump. After 64 min, the pump speed control was increased to deliver 185 mL/min, with a compensating adjustment in the addition funnel drip rate. When a brownish grey suspension appeared on the outlet of the stainless steel tubing, the pump rate was decreased to deliver 11.9 mL/min, with a compensating adjustment in the addition funnel drip rate.

Figure 3:
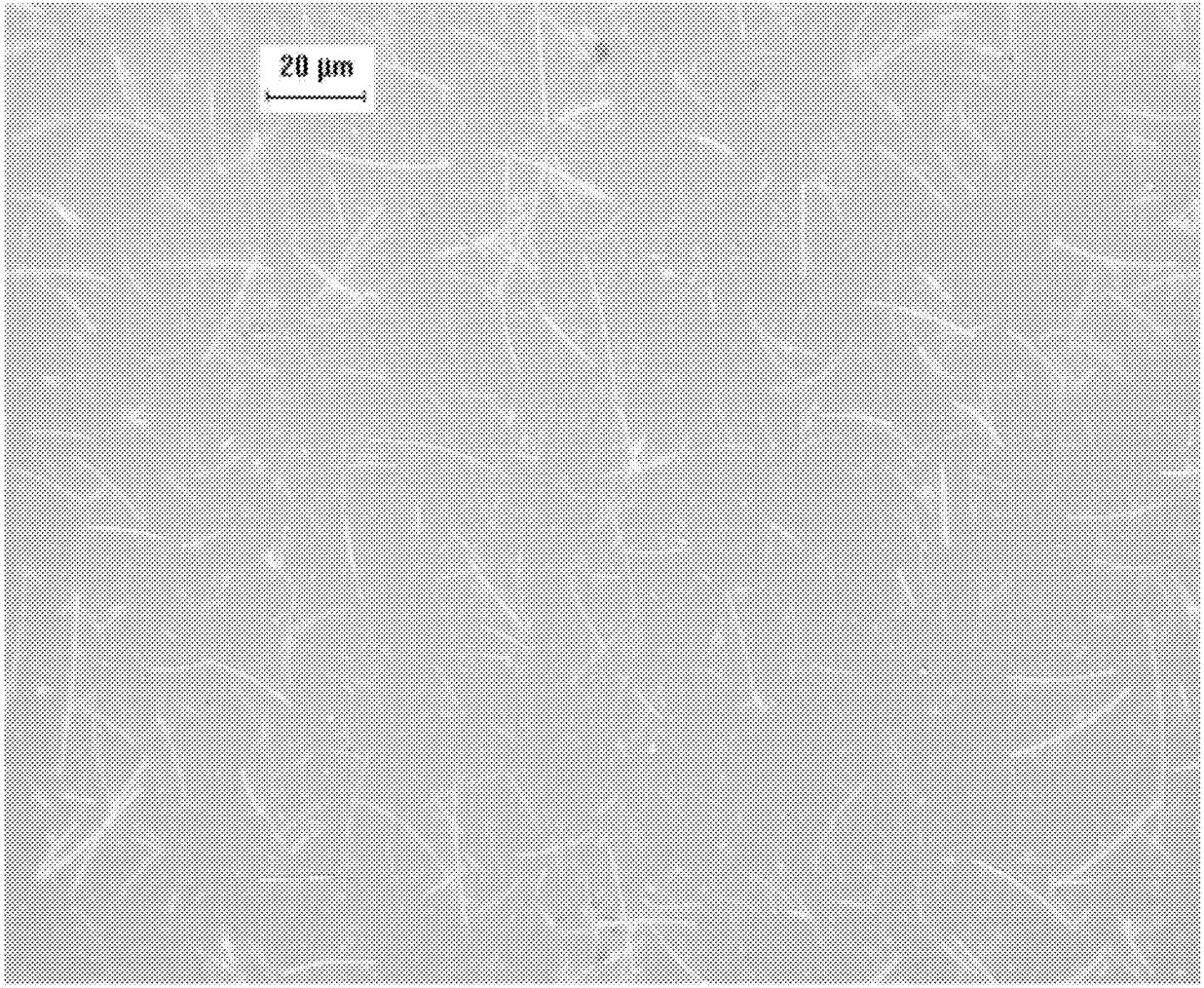
FIG. 3 shows a micrograph of the product suspension of Example 1.

FIG. 3 is a micrograph of the product suspension, showing silver nanowires and many particles.

Example 2

40 mL of a solution of 284.0 g polyvinylpyrrolidone (PVP, 55,000 molecular weight) in 3 L ethylene glycol (EG), 40 mL of a solution of 144.7 g $AgNO_3$ in 3 L of EG, 560 mL of EG, and 2.6 mL of a 13.6 mM solution of $SnCl_2.2H_2O$ in EG were blended and charged to the addition funnel of the apparatus of Experiment 1. The oven was heated to 165° C., after which the pump speed control was set to deliver 11.9 mL/min and the addition funnel drip rate was adjusted to maintain a constant head upstream of the pump. After 95 min, the oven temperature was decreased to 145° C. A grey product suspension was collected from the outlet of the stainless steel tubing.

Figure 4:
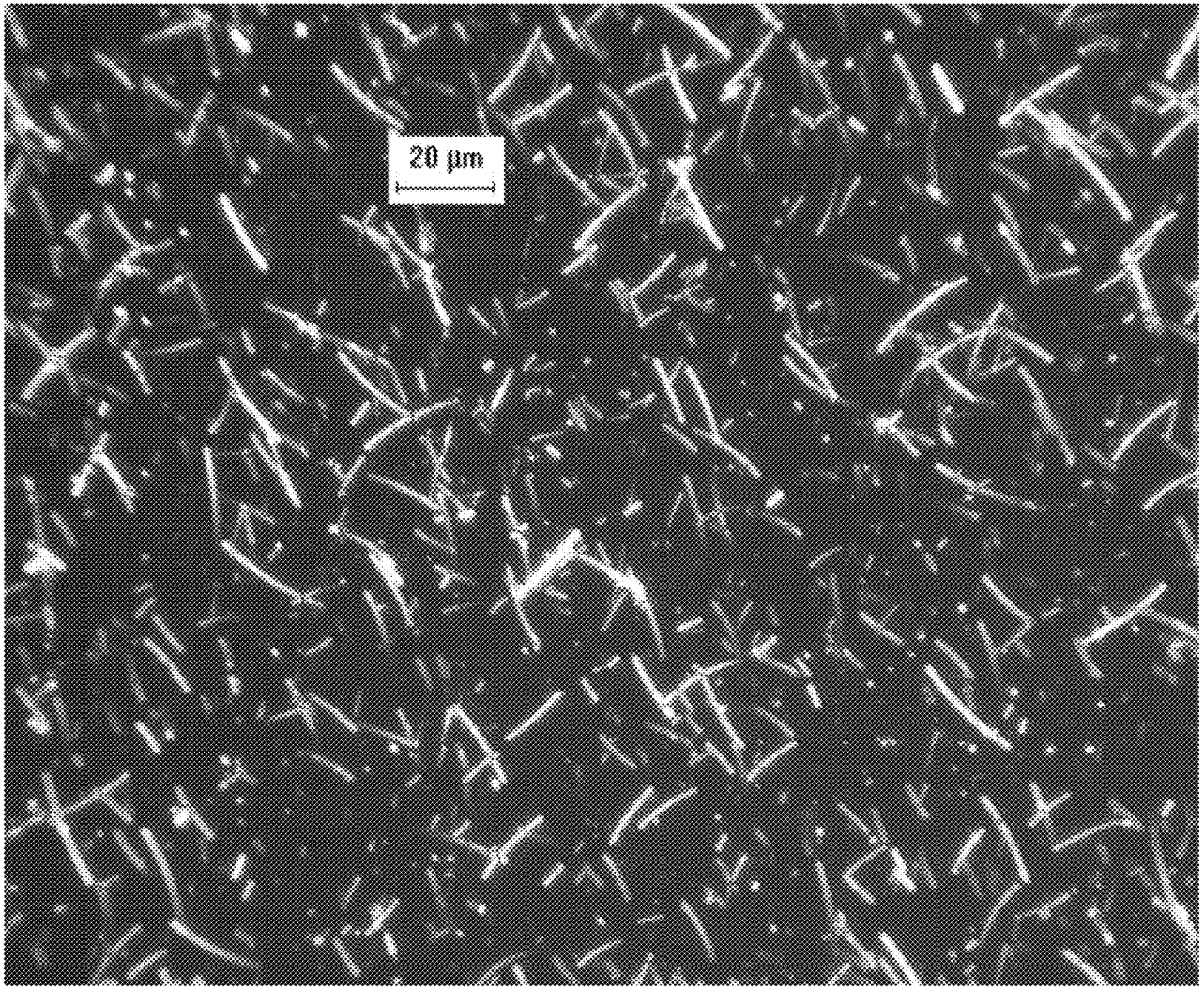
FIG. 4 shows a micrograph of the product suspension of Example 2.

FIG. 4 is a micrograph of the product suspension, showing many ca. 20 nm long silver nanowires, some shorter silver nanowires, and a few particles.

Example 3

Comparative 40 mL of a solution of 284.0 g polyvinylpyrrolidone (PVP, 55,000 molecular weight) in 3 L ethylene glycol (EG), 40 mL of a solution of 144.7 g $AgNO_3$ in 3 L of EG, 560 mL of EG, and 8 mg of $SnCl_2.2H_2O$ in 2.6 mL EG were blended and charged to a 1 L round-bottom flask. This mixture was mechanically agitated at 100 rpm and heated to 165° C. over 59 min. The reaction mixture was held between 163° C. and 166° C. and sampled hourly after 1 hr, 2 hr, and 3 hr at temperature. Each of these 1 g samples were examined microscopically at 500×. In each case, only a few short wires were observed visually and were not easily photographed.

Figure 5:
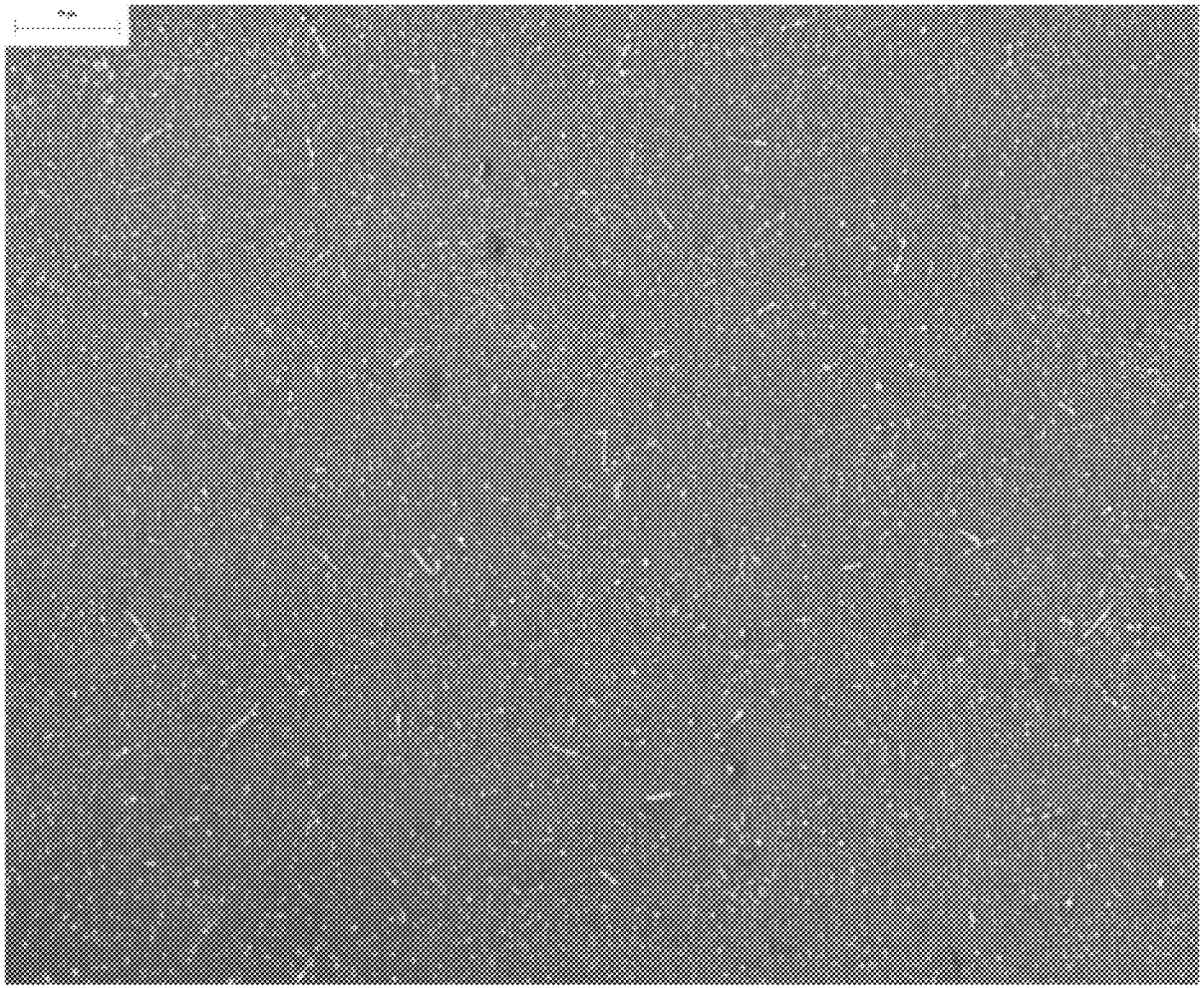
FIG. 5 shows a micograph of the product suspension of Comparative Example 3 after 1 hr at reaction temperature.
Figure 6:
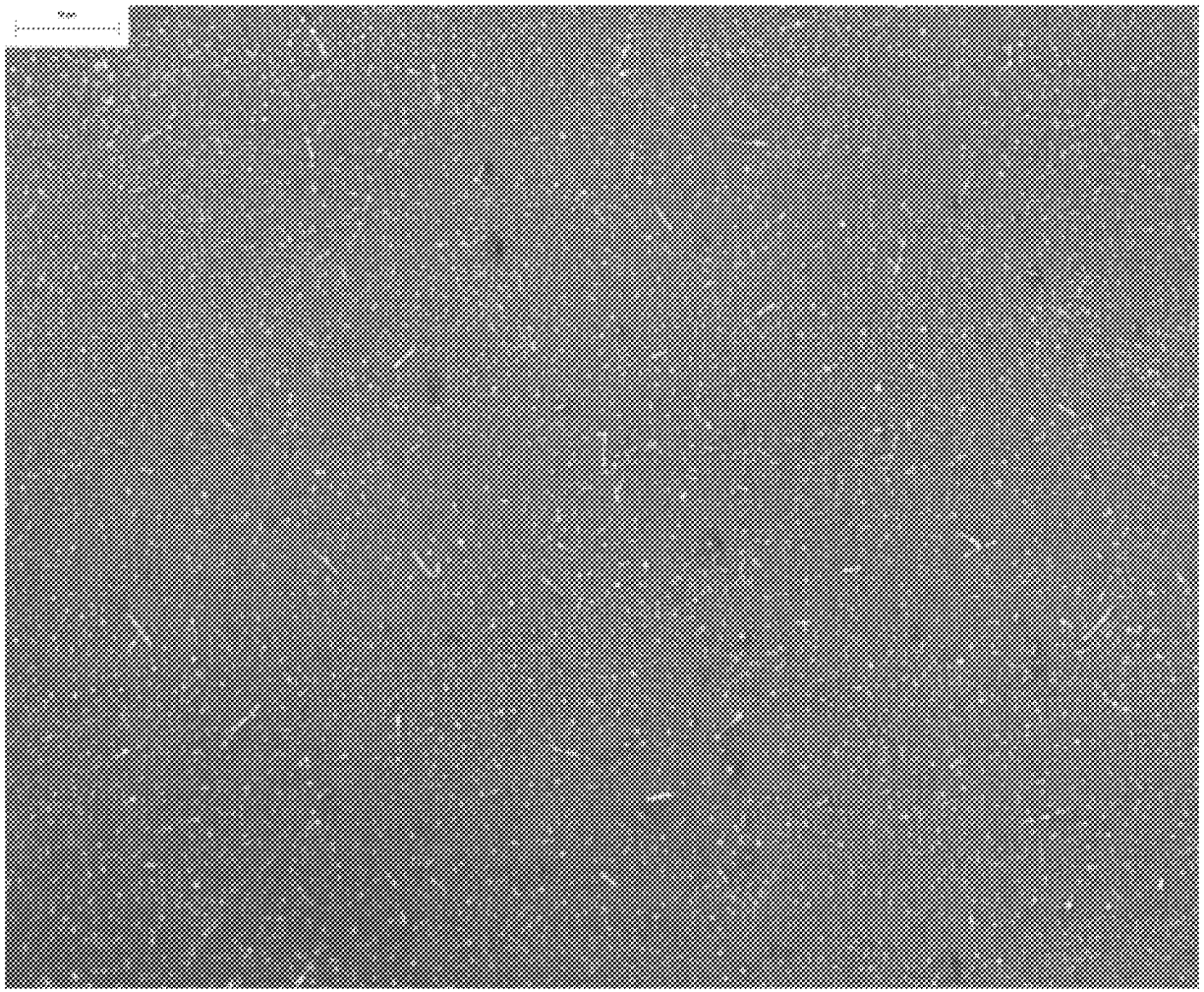
FIG. 6 shows a micograph of the product suspension of Comparative Example 3 after 2 hrs at reaction temperature.
Figure 7:
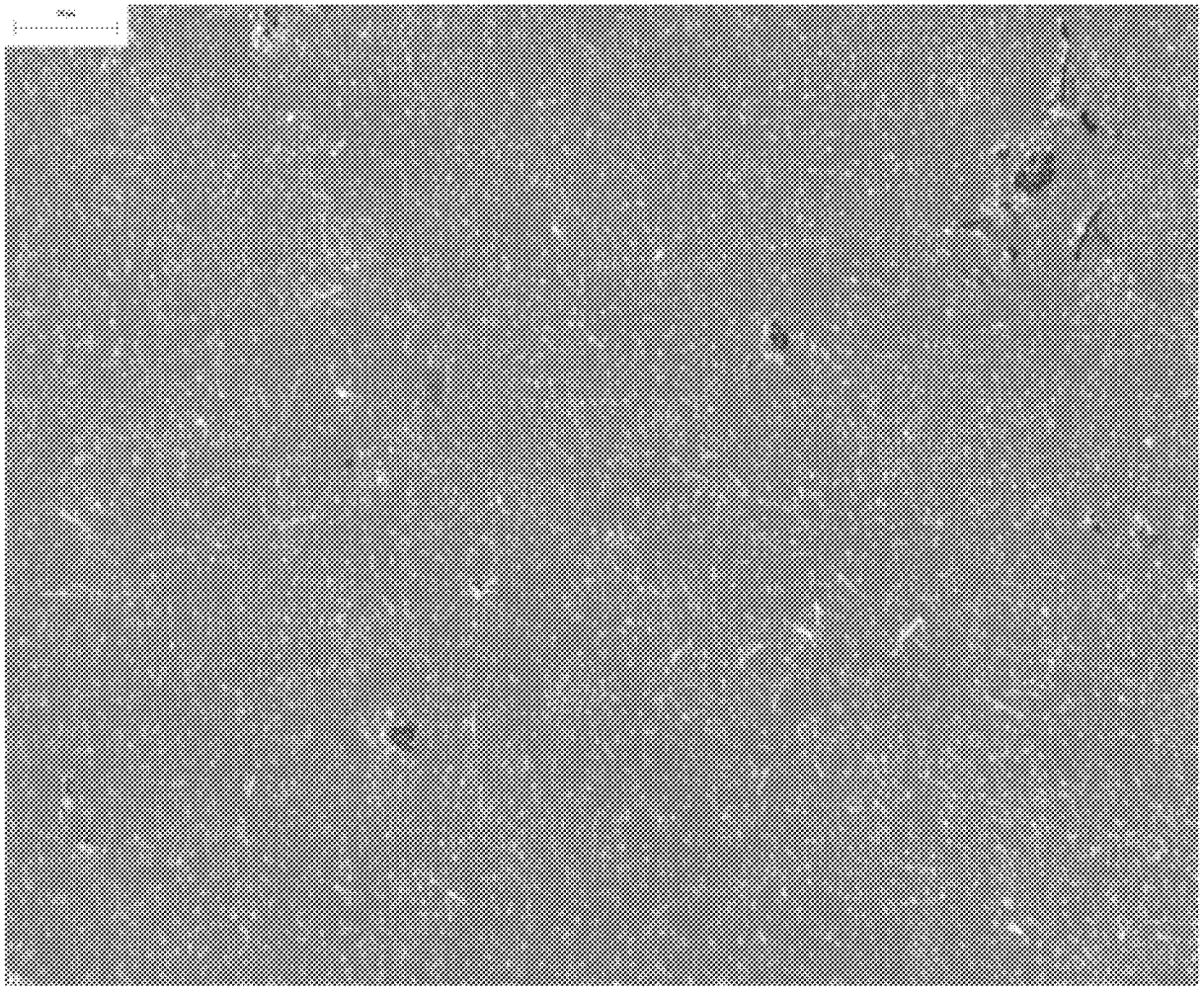
FIG. 7 shows a micograph of the product suspension of Comparative Example 3 after 3 hrs at reaction temperature.

In order to photograph these products, 3 drops of each were diluted with 1 mL of acetone, centrifuged at 500 G for 30 min, the clear supernatant decanted, and the residue dispersed in isopropanol by shaking. These dispersions were applied to glass slides and the liquid evaporated. Photo micrographs were taken of each of these treated glass slides, as shown in FIGS. 5, 6, and 7, showing microparticles with low aspect ratios and very few nanowires.

It is surprising that a batch reactor supplied with the identical feed composition of Example 2 did not produce the same silver nanowire product as that of the continuous-flow reactor of Example 2.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed:

1. A method for continuously growing silver nanowires comprising:

feeding at least one first composition comprising at least one reducible metal ion, at least one tin ion, and at least one protecting agent to the contents of at least one continuous-flow reactor comprising at least one tubular reactor, the at least one reducible ion comprising at least one silver ion;

heating the at least one first composition prior to reducing the at least one reducible metal ion to at least one metal nanowire; and withdrawing at least one second composition comprising the at least one metal nanowire from the contents of the at least one continuous-flow reactor, wherein the reduction is performed in the presence of at least one tin ion or atom.

2. The method according to claim 1, wherein at least some of the withdrawing of the at least one second composition occurs before at least some of the feeding of the at least one first composition.

3. The method according to claim 1, wherein at least some of the withdrawing of the at least one second composition occurs simultaneously with at least some of the feeding of the at least one first composition.

4. The method according to claim 1, wherein the at least one continuous-flow reactor consists essentially of the at least one tubular reactor.

5. The method according to claim 1, wherein the at least one first composition further comprises at least one polyol.

6. The method according to claim 1, wherein the reduction is performed in the presence of at least one halide ion.

7. The method according to claim 1, wherein the at least one metal nanowire comprises a length of at least about 10 μm.

8. The method according to claim 1, wherein the at least one protecting agent comprises at least one polar polymer or at least one polar copolymer.

9. The method according to claim 1, further comprising heating the at least one first composition, wherein at least a portion of the heating the at least one first composition occurs simultaneously with the reducing the at least one first reducible metal ion.

* * * * *

UNITED STATES PATENT AND TRADEMARK OFFICE

CERTIFICATE OF CORRECTION

PATENT NO. : 8,551,211 B2
APPLICATION NO. : 13/347986
DATED : October 8, 2013
INVENTOR(S) : Richard R. Ollmann et al.

It is certified that error appears in the above-identified patent and that said Letters Patent is hereby corrected as shown below:

On the Title Page

Item (12) Inventor should read --Ollmann et al.--
Inventor

Item (75) Inventors should read --Richard R. Ollmann, Woodbury, MN (US); William D. Ramsden, Afton, MN (US); Doreen C. Lynch, Afton, MN (US)--
Inventors Signed and Sealed this
Eleventh Day of March, 2014

Michelle K. Lee

Michelle K. Lee
*Deputy Director of the United States Patent and Trademark Office*